US007786834B2

(12) United States Patent
Yagasaki et al.

(10) Patent No.: US 7,786,834 B2
(45) Date of Patent: Aug. 31, 2010

(54) INDUCTOR AND ITS MANUFACTURING METHOD

(75) Inventors: Toshiyuki Yagasaki, Takasaki (JP); Tomoo Kashiwa, Takasaki (JP); Hideki Ogawa, Takasaki (JP); Kouichirou Wada, Takasaki (JP); Yoshikazu Okino, Takasaki (JP); Sholchi Tosaka, Takasaki (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 0 days.

(21) Appl. No.: 12/269,883

(22) Filed: Nov. 13, 2008

(65) Prior Publication Data

US 2009/0128275 A1 May 21, 2009

(30) Foreign Application Priority Data

Nov. 15, 2007 (JP) ..... 2007-296394

(51) Int. Cl.
*H01F 27/29* (2006.01)

(52) U.S. Cl. ..... 336/192

(58) Field of Classification Search ..... 336/65, 336/83, 90, 96, 192, 200, 232
See application file for complete search history.

(56) References Cited

U.S. PATENT DOCUMENTS

| | | | | |
|---|---|---|---|---|
| 7,142,084 | B2 * | 11/2006 | Cheng | 336/200 |
| 2004/0189431 | A1 * | 9/2004 | Shibata et al. | 336/83 |
| 2006/0049907 | A1 * | 3/2006 | Liu | 336/200 |

FOREIGN PATENT DOCUMENTS

| | | | |
|---|---|---|---|
| JP | 2003-282346 | A1 | 10/2003 |
| JP | 2004-153068 | A1 | 5/2004 |

* cited by examiner

*Primary Examiner*—Tuyen Nguyen
(74) *Attorney, Agent, or Firm*—Law Office of Katsuhiro Arai

(57) ABSTRACT

An inductor 10 has a magnetic body 11 of a rectangular solid shape and a coil 12 embedded in the magnetic body 11. The coil 12 integrally has a part constituted by a helically wound coil wire, two leader parts 12*a* provided at the two ends of the wound part, and terminal parts 13 connected to the ends of the leader parts and wider than the leader parts 12*a*, where the boundary between each leader part 12*a* and each terminal part 13 is positioned in the magnetic body 11, and the end of each terminal part 13 is exposed from the corresponding side face of the magnetic body 11 and folded in an L shape along the side face and bottom face.

9 Claims, 14 Drawing Sheets

(A)

[Fig. 1]
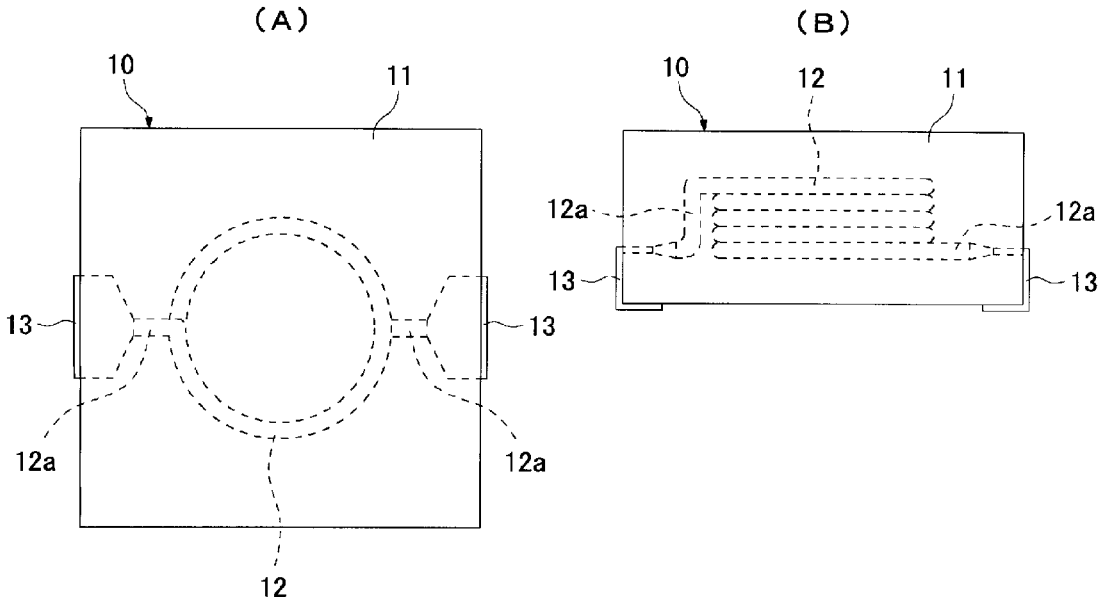
[Fig. 2]
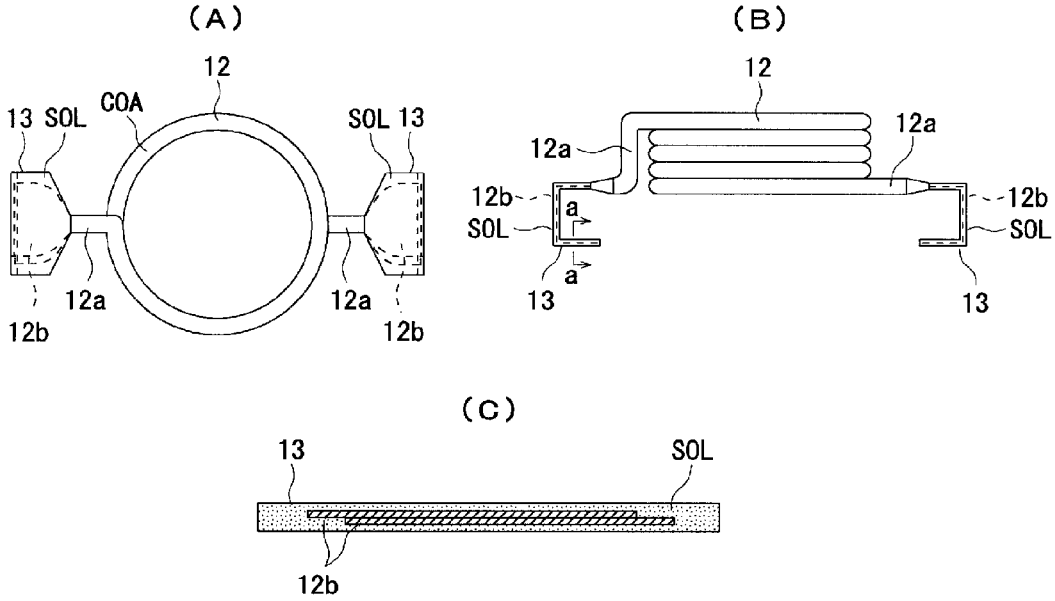

[Fig. 3]
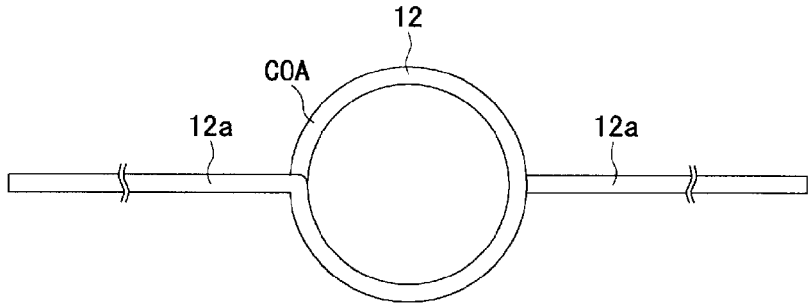
[Fig. 4]
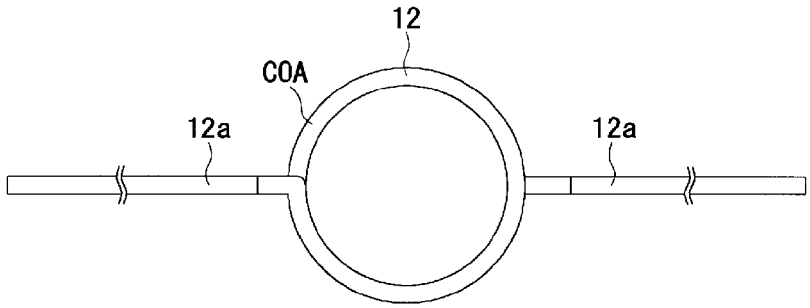
[Fig. 5]
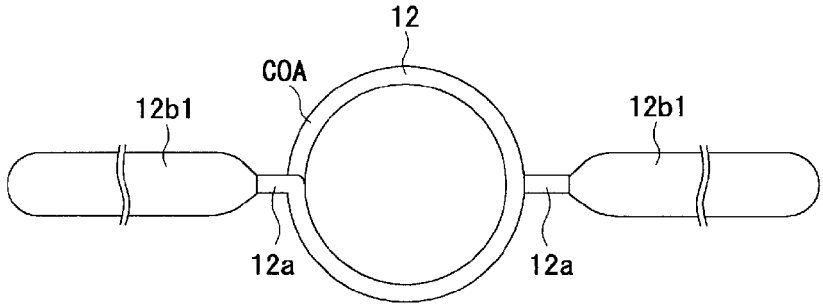
[Fig. 6]
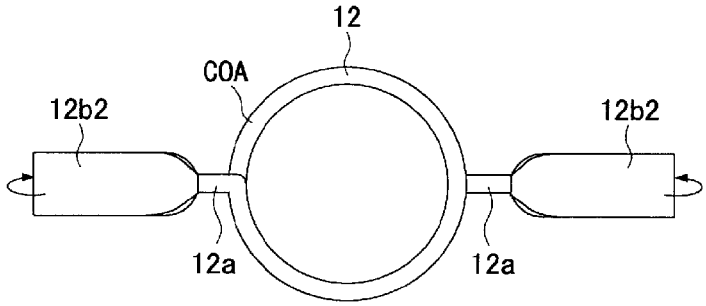

[Fig. 7]
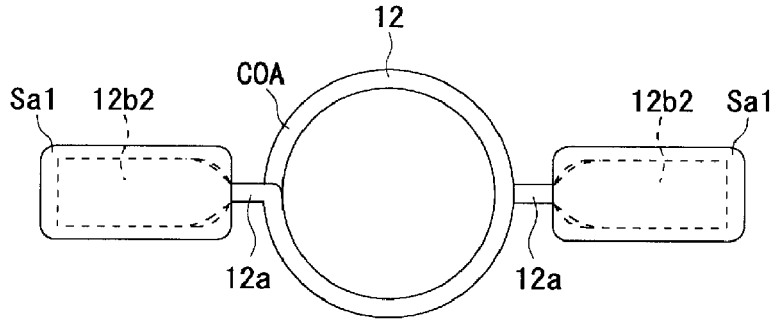
[Fig. 8]
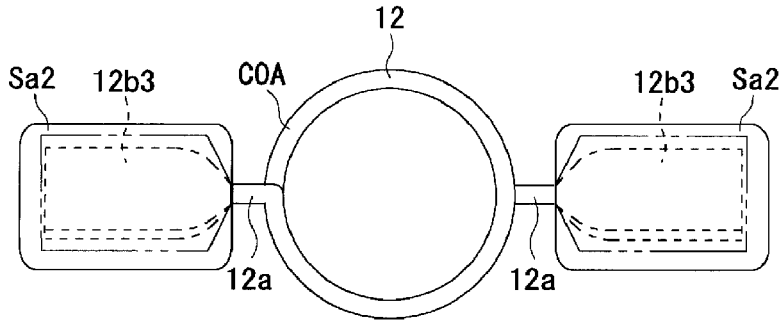
[Fig. 9]
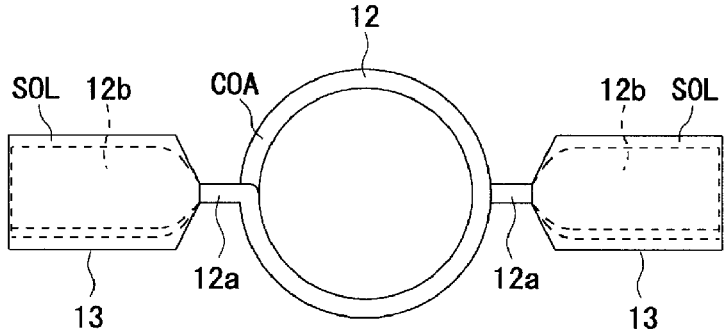

[Fig. 10]
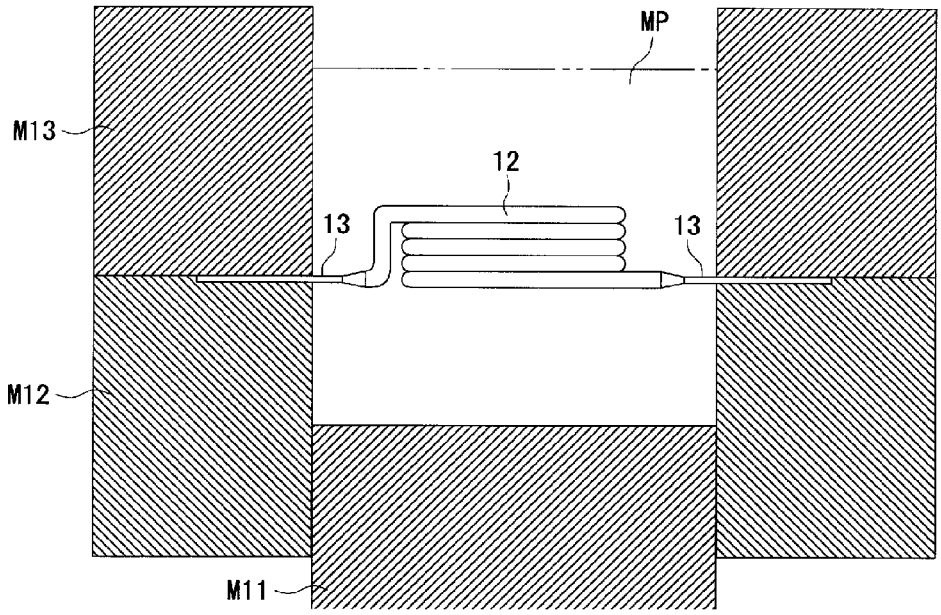
[Fig. 11]
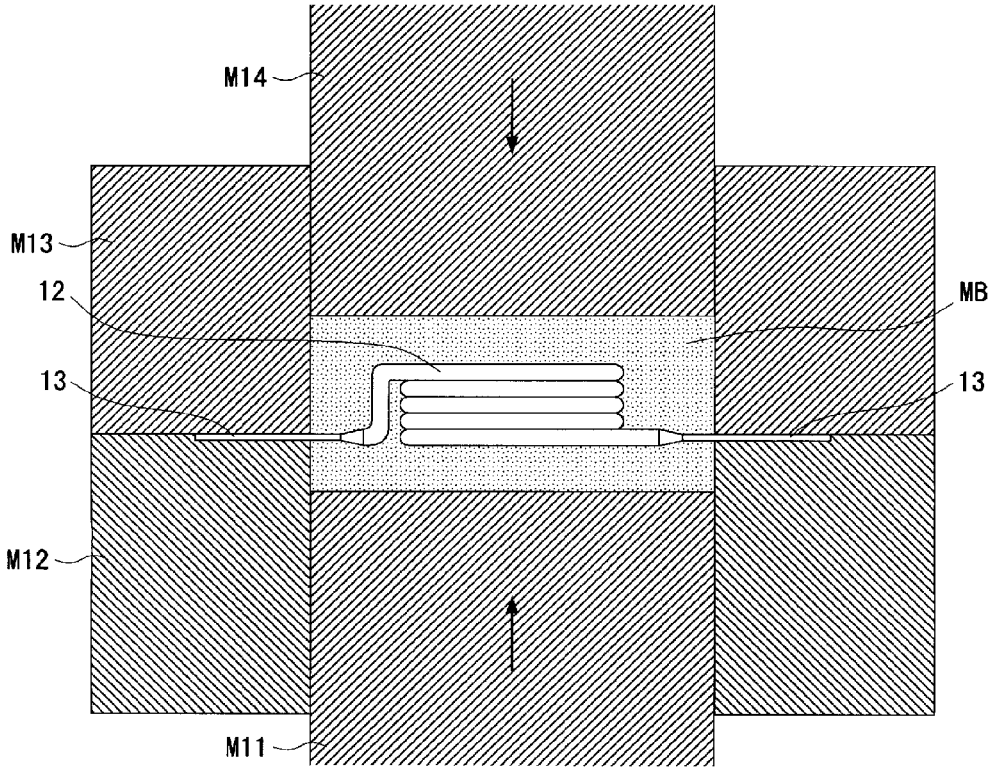

[Fig. 12]
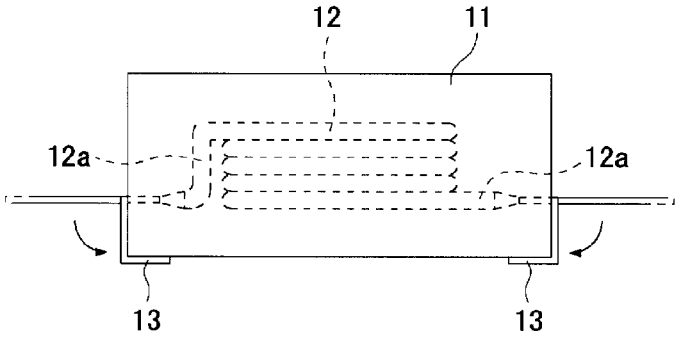
[Fig. 13]
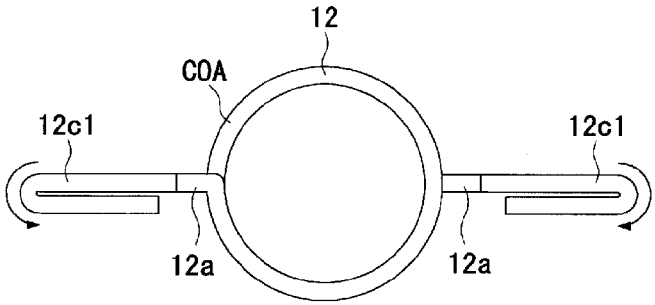
[Fig. 14]
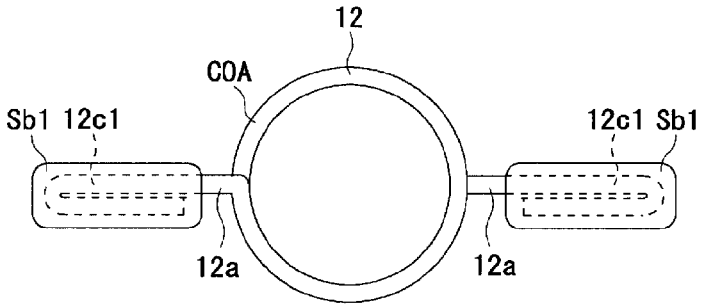
[Fig. 15]
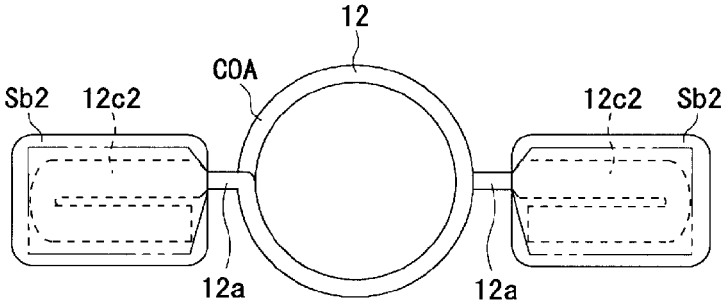

[Fig. 16]
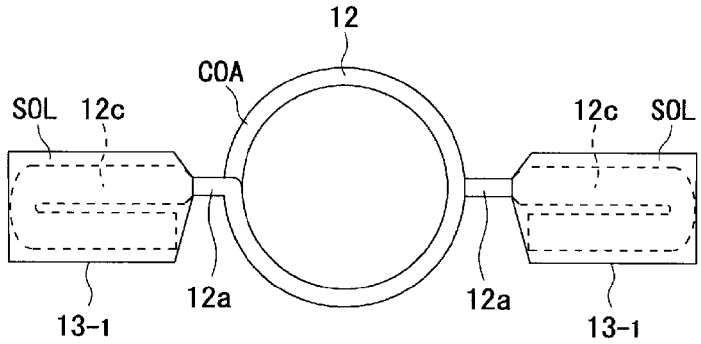
[Fig. 17]
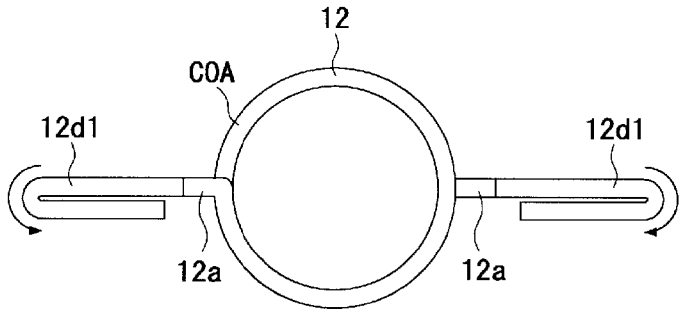
[Fig. 18]
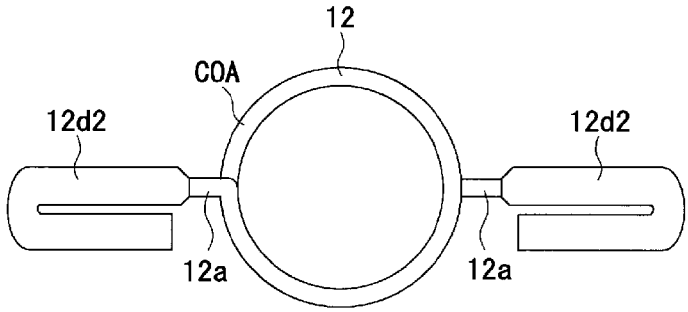
[Fig. 19]
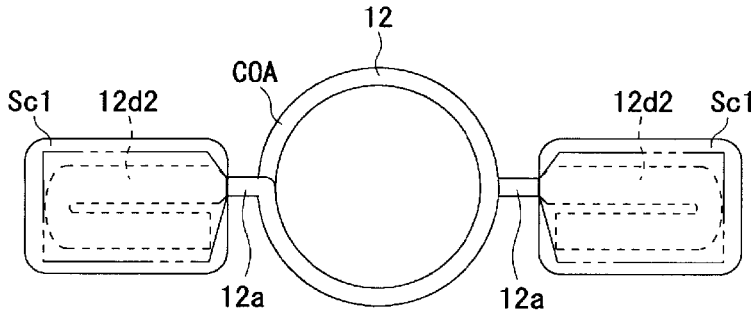

[Fig. 20]
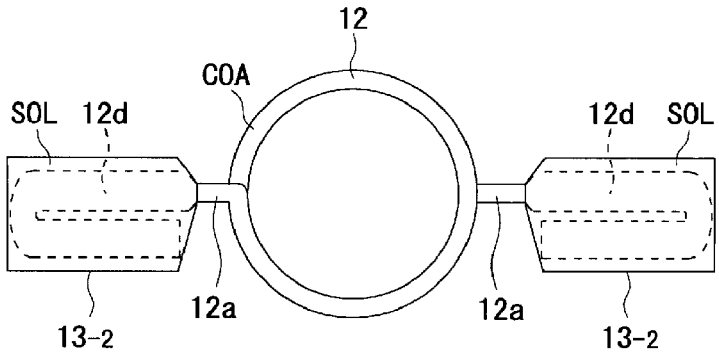
[Fig. 21]
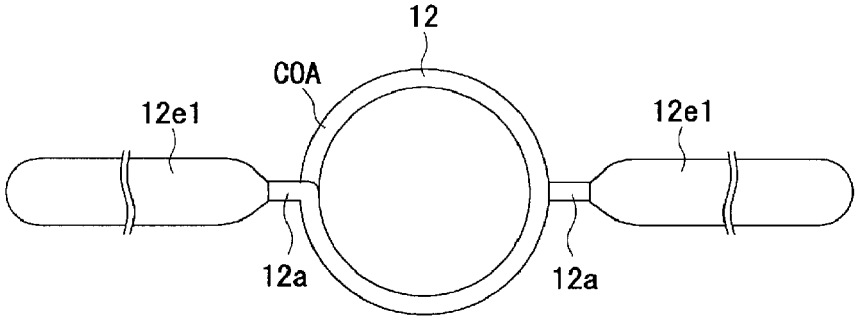
[Fig. 22]
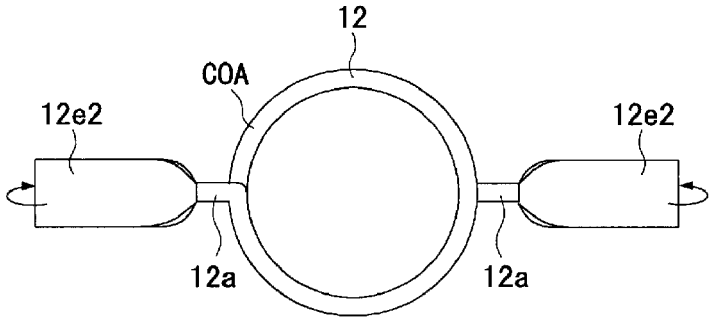
[Fig. 23]
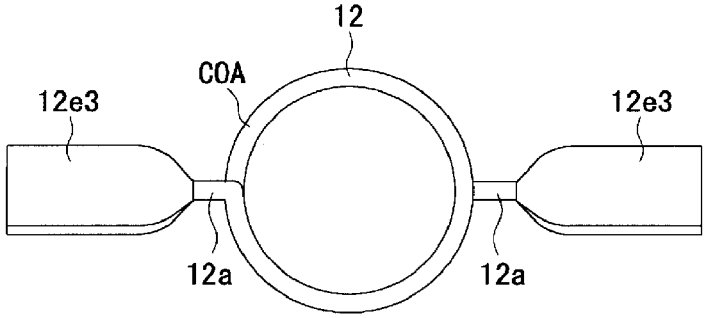

[Fig. 24]
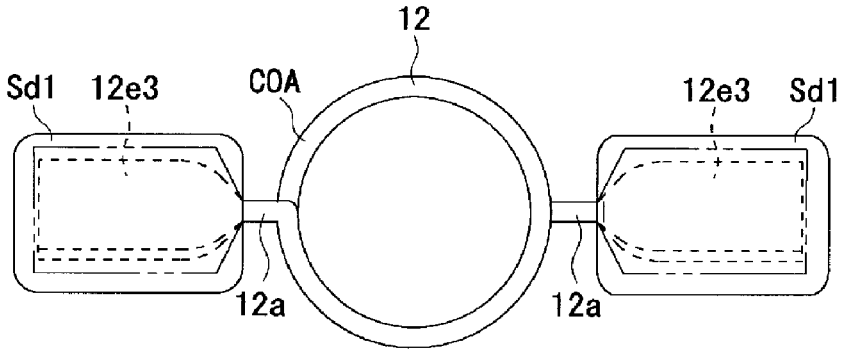
[Fig. 25]
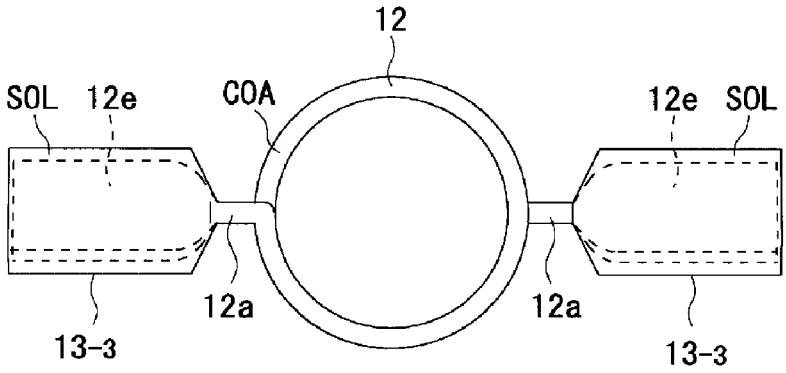

[Fig. 26]
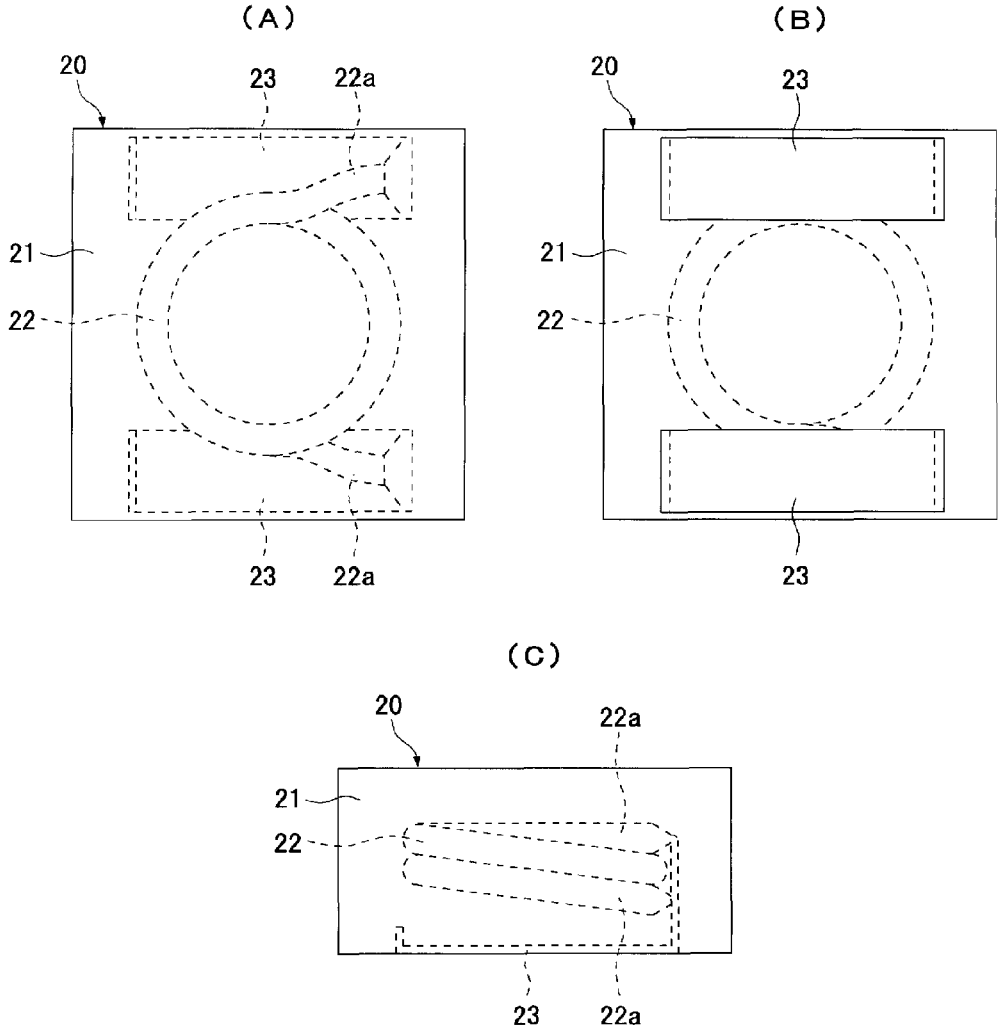

[Fig. 27]
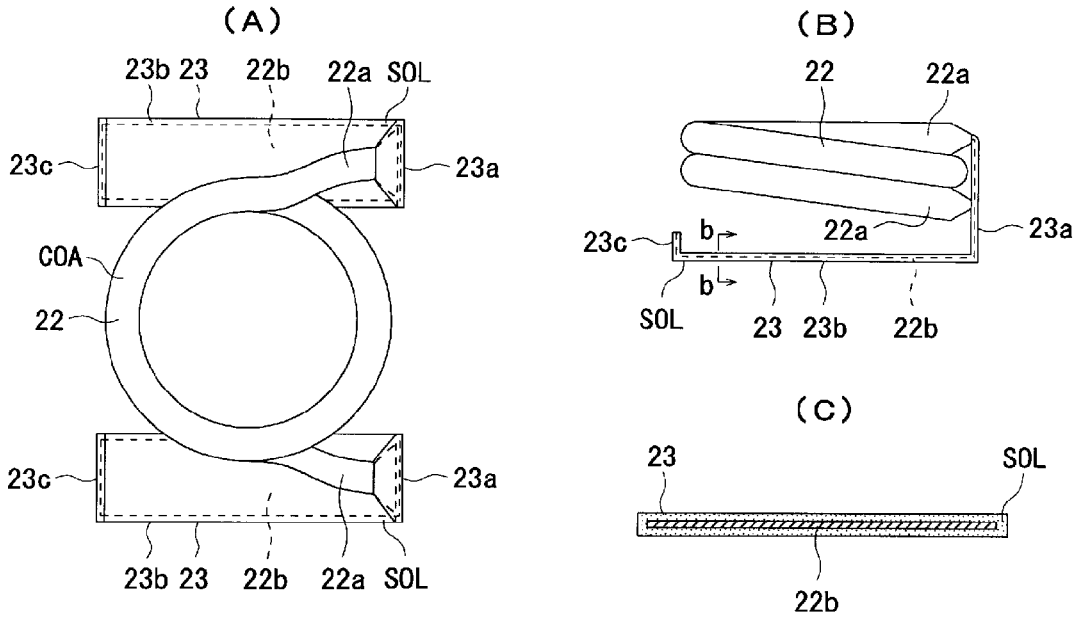
[Fig. 28]
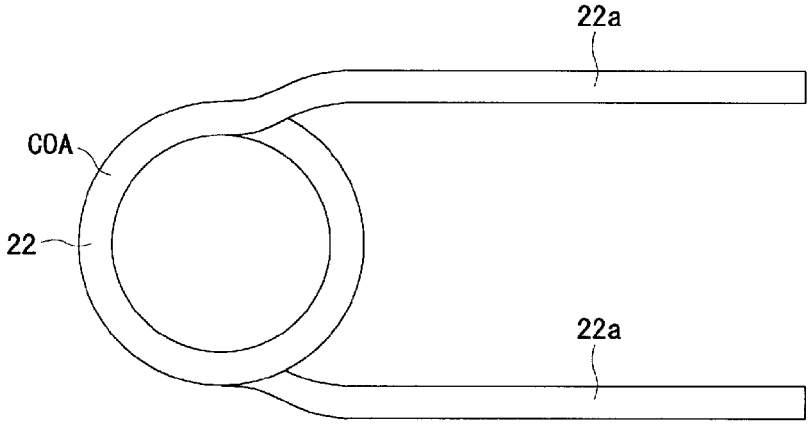
[Fig. 29]
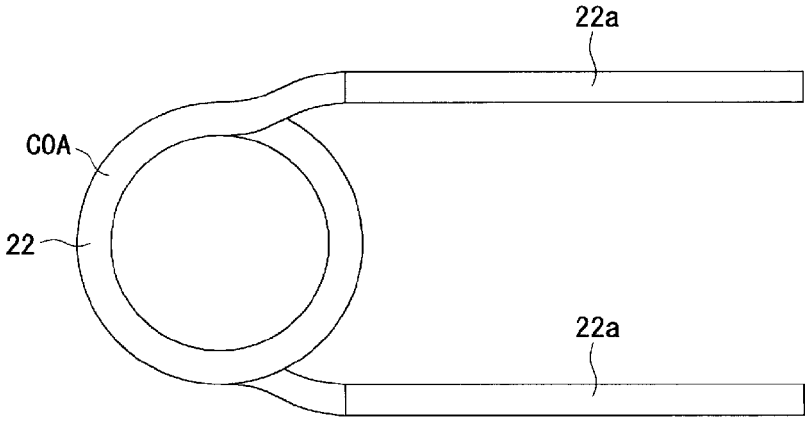

[Fig. 30]
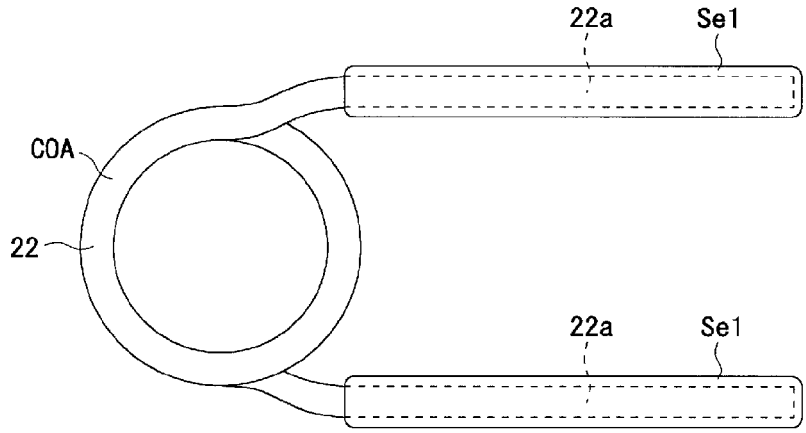
[Fig. 31]
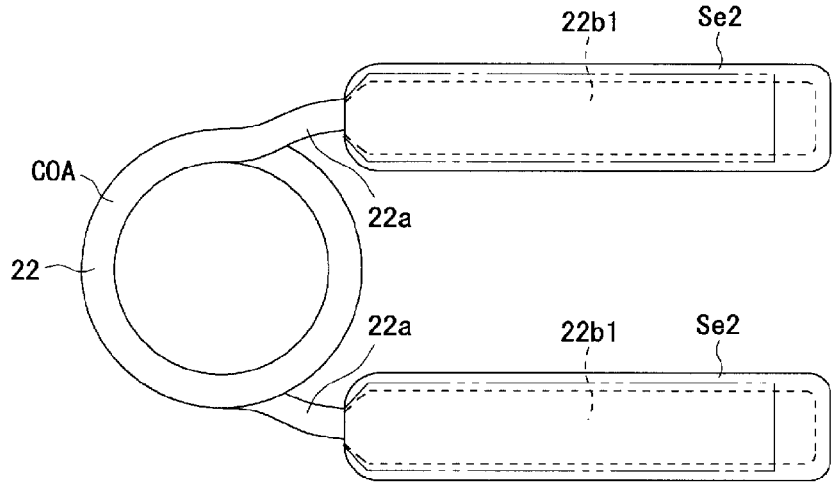
[Fig. 32]
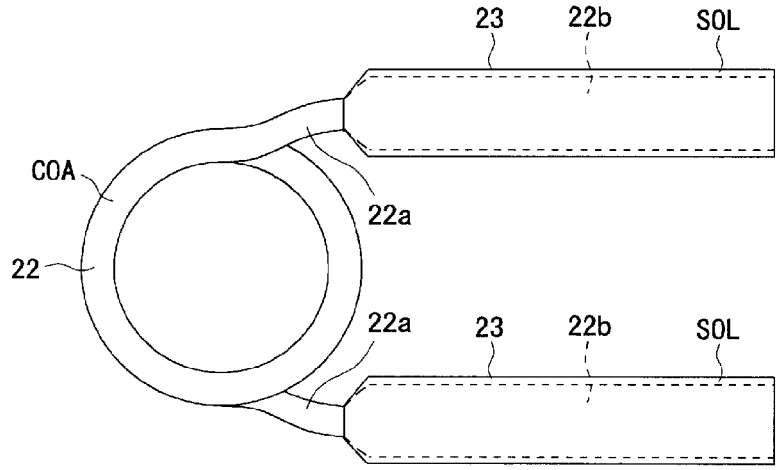

[Fig. 33]
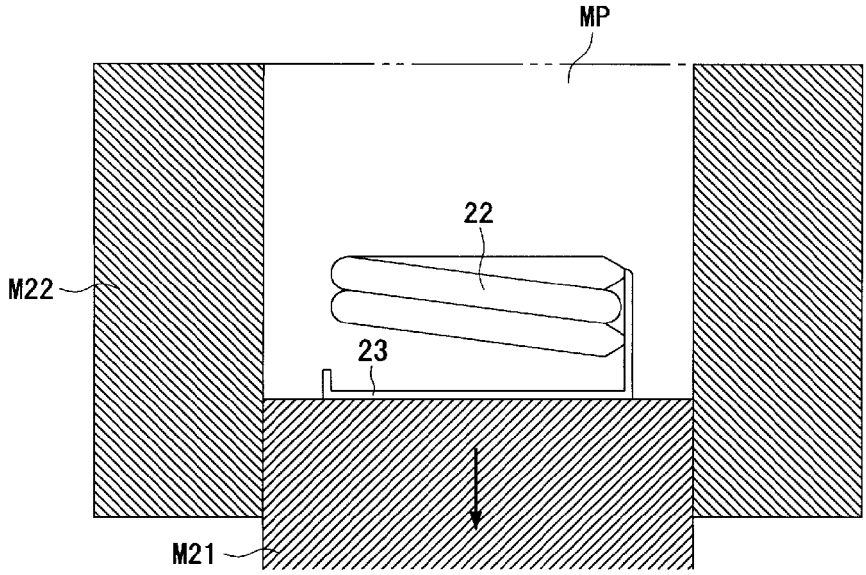
[Fig. 34]
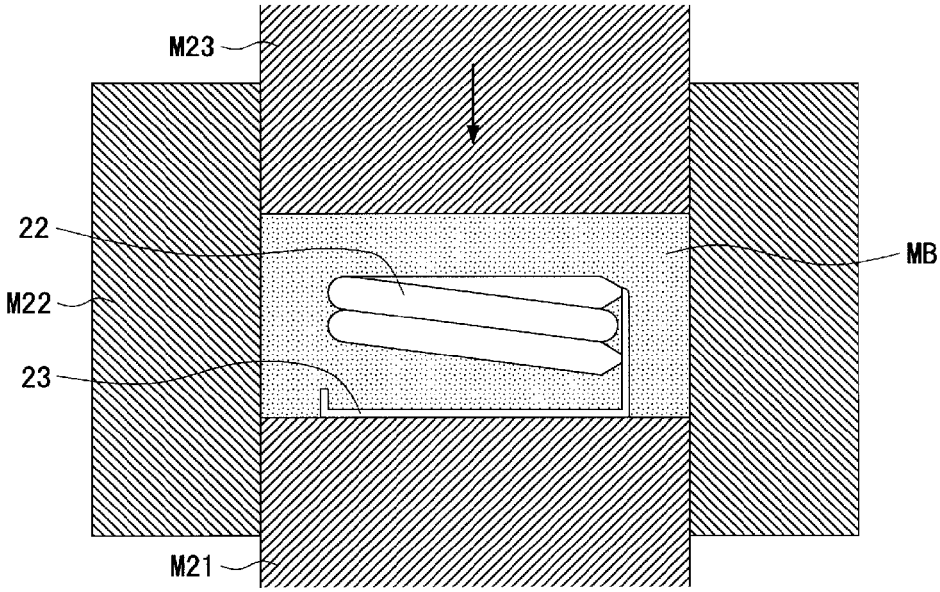

[Fig. 35]
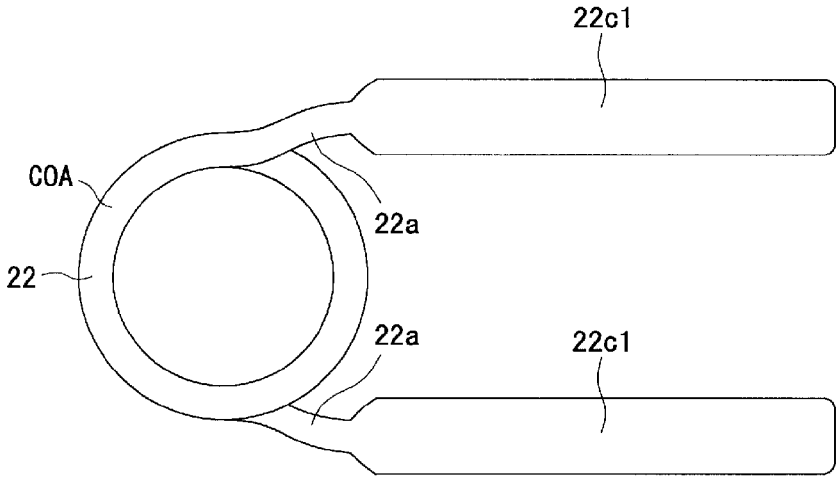
[Fig. 36]
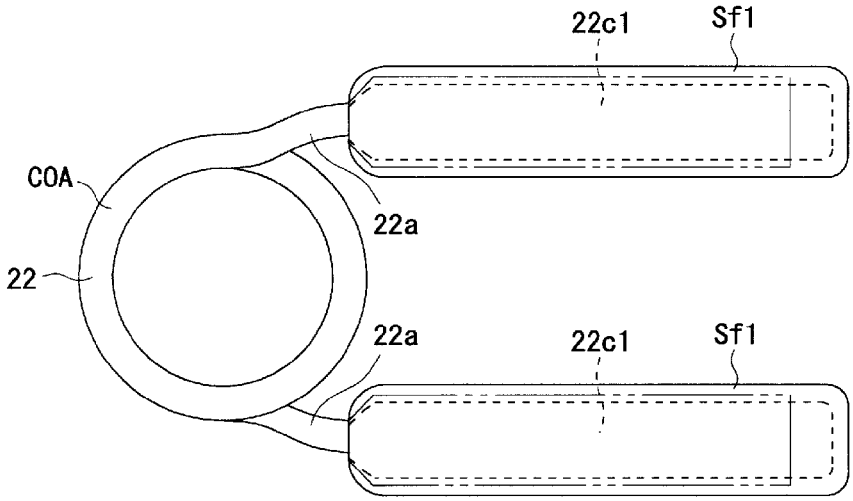
[Fig. 37]
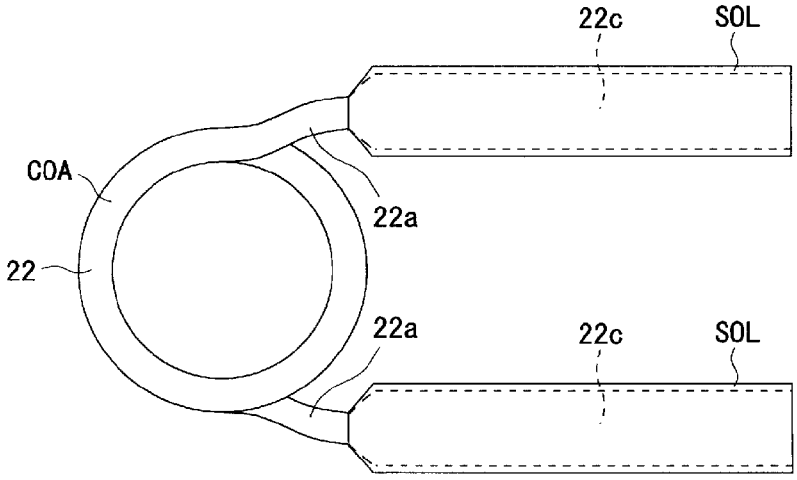

[Fig. 38]
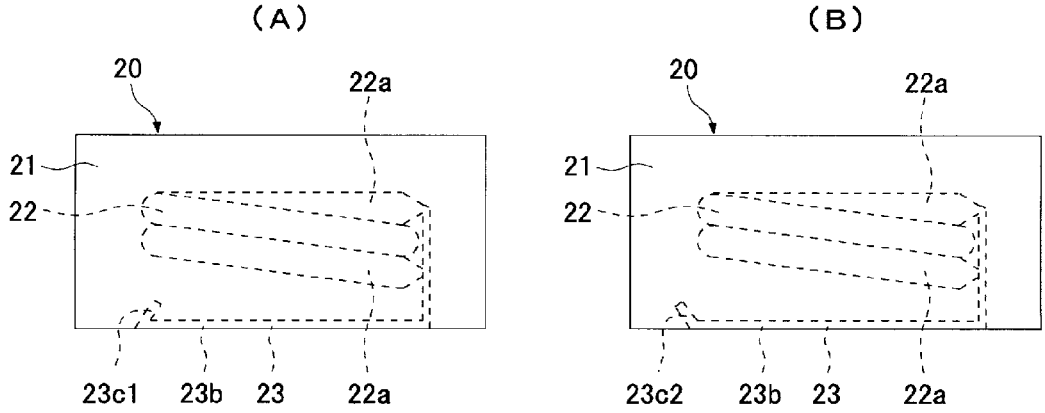
[Fig. 39]
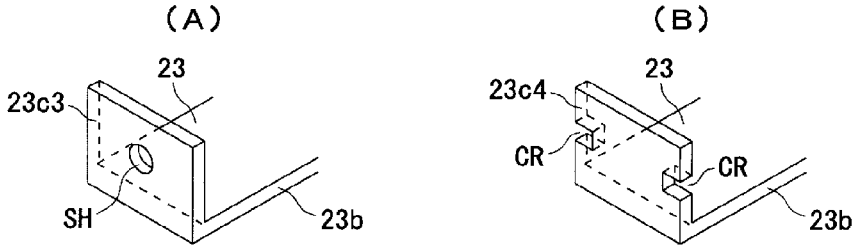
[Fig. 40]
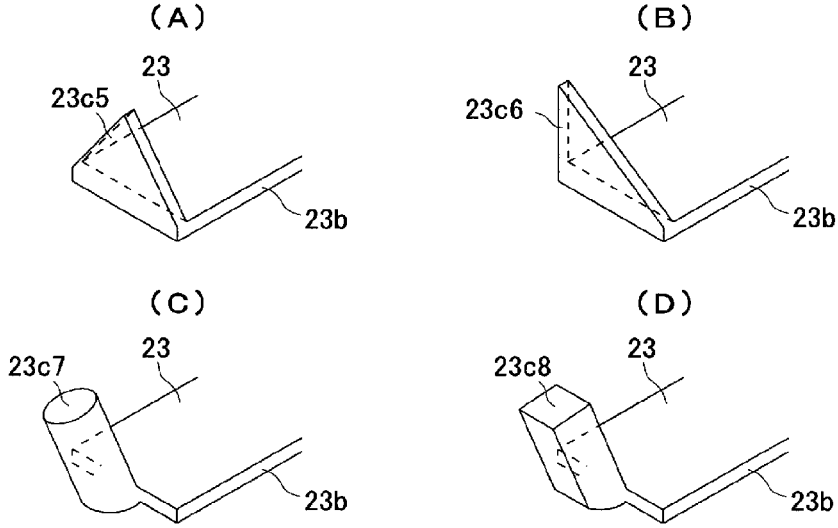

INDUCTOR AND ITS MANUFACTURING METHOD

BACKGROUND OF THE INVENTION

1. Field of the Invention

The present invention relates to an inductor structured in such a way that a coil is buried in a magnetic body, and a method for manufacturing said inductor.

2. Description of the Related Art

This type of inductor has a magnetic body of a specified shape and a coil buried in the magnetic body.

As described in Patent Literatures 1 and 2, coils having the aforementioned structure and currently in use include those that integrally have a part constituted by helically wound coil wire, two leader parts provided at the two ends of the wound part and terminal parts connected to these leader parts and wider than the leader parts. With these coils, when a magnetic body material is pressure-formed to a specified shape the coil is buried in the formed body so that each terminal part will be exposed entirely from the formed body, while each terminal part exposed from the formed body is bent at the boundary between the terminal part and leader part along the surface of the magnetic body after the curing process, with the obtained product used as a surface-mounted terminal.

Patent Literature 1: Japanese Patent Laid-open No. 2003-282346

Patent Literature 2: Japanese Patent Laid-open No. 2004-153068

Since the aforementioned inductor has a structure where each terminal part of the coil is exposed entirely and also the boundary between each leader part and each terminal part wider than the leader part is exposed from the magnetic body, there are risks that cracks that cause poor connection due to wire breakage, etc., may generate at the aforementioned boundary if an external force is applied to each exposed terminal part or when the inductor is soldered to a circuit board.

SUMMARY OF THE INVENTION

In an aspect, at least one embodiment of the present invention was created in light of the aforementioned situations, and is to provide an inductor capable of maintaining the connection relationship between each leader part and each terminal part in a favorable manner. In another aspect, at least one embodiment of the present invention is also to provide a manufacturing method suitable for such inductor capable of maintaining connection relationship between each leader part and each terminal part in a favorable manner.

In view of the aforementioned purposes, an inductor conforming to an embodiment of the present invention has a magnetic body of a specified shape and a coil buried in the magnetic body, where the coil integrally has a part constituted by a helically wound coil conductor, two leader parts provided at the two ends of the wound part, and two terminal parts connected to the ends of these leader parts and wider than the leader parts. The boundary between each leader part and terminal part is positioned in the magnetic body, and each terminal is partially exposed to the surface of the magnetic body.

According to this inductor, stress does not generate easily at the boundary between each leader part and each terminal part wider than the leader part, even when an external force is applied to the exposed part of each terminal part or when the inductor is soldered to a circuit board, and thus the risks of generation at the aforementioned boundary of cracks that cause poor connection due to wire breakage, etc., can be eliminated and consequently the connection relationship between the leader part and terminal part can be maintained in a favorable manner.

Also, a manufacturing method conforming to an embodiment of the present invention provides a method for manufacturing an inductor with a magnetic body of a specified shape and coil buried in the magnetic body, wherein said method consists of: a coil forming process to helically wind a coil wire to integrally form a wound part, two leaders at the ends of the wound part, and terminal parts connected to the leader parts and wider than the leader parts; and a magnetic-body material forming process to pressure-form a magnetic body material to a specified shape by burying the coil in the formed body in such a way that the boundary between each leader part and each terminal part of the coil will be positioned in the formed body and that each terminal part of the coil will be partially exposed from the formed body.

According to this inductor manufacturing method, the aforementioned inductor can be manufactured in a favorable and stable manner.

For purposes of summarizing aspects of the invention and the advantages achieved over the related art, certain objects and advantages of the invention are described in this disclosure. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description which follows.

BRIEF DESCRIPTION OF THE DRAWINGS

These and other features of this invention will now be described with reference to the drawings of preferred embodiments which are intended to illustrate and not to limit the invention. The drawings are oversimplified for illustrative purposes and are not to scale.

FIGS. 1A and 1B are top view and side view of an inductor, respectively, pertaining to Embodiment 1.

FIGS. 2A, 2B, and 2C are top view, side view, and enlarged cross-section view of the terminal (enlarged cross-section view of a-a) of the coil, respectively, shown in FIGS. 1A and 1B.

FIG. 3 is an explanatory drawing illustrating a step of a coil creation method.

FIG. 4 is an explanatory drawing illustrating a step of a coil creation method.

FIG. 5 is an explanatory drawing illustrating a step of a coil creation method.

FIG. 6 is an explanatory drawing illustrating a step of a coil creation method.

FIG. 7 is an explanatory drawing illustrating a step of a coil creation method.

FIG. 8 is an explanatory drawing illustrating a step of a coil creation method.

FIG. 9 is an explanatory drawing illustrating a step of a coil creation method.

FIG. 10 is an explanatory drawing illustrating a step of a method for pressure-forming the magnetic body material and burying the coil.

FIG. 11 is an explanatory drawing illustrating a step of a method for pressure-forming the magnetic body material and burying the coil.

FIG. 12 is an explanatory drawing illustrating a step of a method for folding the exposed part of the terminal.

FIG. 13 is an explanatory drawing illustrating a step of a first variation example of a coil creation method.

FIG. 14 is an explanatory drawing illustrating a step of the first variation example of a coil creation method.

FIG. 15 is an explanatory drawing illustrating a step of the first variation example of a coil creation method.

FIG. 16 is an explanatory drawing illustrating a step of the first variation example of a coil creation method.

FIG. 17 is an explanatory drawing illustrating a step of a second variation example of a coil creation method.

FIG. 18 is an explanatory drawing illustrating a step of the second variation example of a coil creation method.

FIG. 19 is an explanatory drawing illustrating a step of the second variation example of a coil creation method.

FIG. 20 is an explanatory drawing illustrating a step of the second variation example of a coil creation method.

FIG. 21 is an explanatory drawing illustrating a step of a third variation example of a coil creation method.

FIG. 22 is an explanatory drawing illustrating a step of the third variation example of a coil creation method.

FIG. 23 is an explanatory drawing illustrating a step of the third variation example of a coil creation method.

FIG. 24 is an explanatory drawing illustrating a step of the third variation example of a coil creation method.

FIG. 25 is an explanatory drawing illustrating a step of the third variation example of a coil creation method.

FIGS. 26A, 26B, and 26C are top view, side view, and side view of an inductor, respectively, pertaining to Embodiment 2.

FIGS. 27A, 27B, and 27C are top view, side view, and enlarged cross-section view of the terminal (enlarged cross-section view of b-b) of the coil, respectively, shown in FIG. 26.

FIG. 28 is an explanatory drawing illustrating a step of a coil creation method.

FIG. 29 is an explanatory drawing illustrating a step of a coil creation method.

FIG. 30 is an explanatory drawing illustrating a step of a coil creation method.

FIG. 31 is an explanatory drawing illustrating a step of a coil creation method.

FIG. 32 is an explanatory drawing illustrating a step of a coil creation method.

FIG. 33 is an explanatory drawing illustrating a step of a method for pressure-forming the magnetic body material and burying the coil.

FIG. 34 is an explanatory drawing illustrating a step of a method for pressure-forming the magnetic body material and burying the coil.

FIG. 35 is an explanatory drawing illustrating a step of a first variation example of a coil creation method.

FIG. 36 is an explanatory drawing illustrating a step of the first variation example of a coil creation method.

FIG. 37 is an explanatory drawing illustrating a step of the first variation example of a coil creation method.

FIGS. 38A and 38B are drawings illustrating a first and a second variation examples of a stopper part of the terminal part, respectively.

FIGS. 39A and 39B are drawings illustrating a third and a fourth variation examples of a stopper part of the terminal part, respectively.

FIGS. 40A, 40B, 40C, and 40D are drawings illustrating a fifth through eighth variation examples of a stopper part of the terminal part, respectively.

DESCRIPTION OF THE SYMBOLS

10—Inductor, 11—Magnetic body, 12—Coil, COA—Insulation sheath, 12*a*—Leader part, 12*b*—Wide part, SOL—Soldered part, 13, 13-1, 13-2, 13-3—Terminal parts, 20—inductor, 21—Magnetic body, 22—Coil, COA—Insulation sheath, 22*a*—Leader part, 22*b*—Wide part, SOL—Soldered part, 23, 23-1—Terminal parts, 23*b*—Exposed part, 23*c*, 23*c*1, 23*c*2, 23*c*3, 23*c*4, 23*c*5, 23*c*6, 23*c*7, 23*c*8—Stopper parts

DETAILED DESCRIPTION OF THE PREFERRED EMBODIMENT

Embodiments are described below with reference to drawings. However, the embodiments and drawings are not intended to limit the present invention. In the present disclosure where conditions and/or structures are not specified, the skilled artisan in the art can readily provide such conditions and/or structures, in view of the present disclosure, as a matter of routine experimentation. Also, in the present disclosure, the numerical numbers applied in specific embodiments can be modified by a range of at least ±50% in other embodiments, and the ranges applied in embodiments may include or exclude the endpoints.

EMBODIMENT 1

FIGS. 1 (A) and 1 (B) provide a top view and side view, respectively, of an inductor which illustrates an embodiment of the present invention.

The inductor 10 shown in these figures has a magnetic body 11 of a rectangular solid shape and a coil 12 buried in the magnetic body 11.

The magnetic body 11 is formed by pressure-forming a magnetic body material to a rectangular solid shape and then curing the formed body. For your information, examples of magnetic body materials currently in use include, among others, known materials such as those that include at least permalloy, sendust or other magnetic metal powder, or epoxy, phenol, silicone or other binding agent.

The coil 12, whose top view, side view and enlarged cross-section view of the terminal (enlarged cross-section view of a-a) are shown in FIGS. 2 (A) to 2 (C), consists of a metal wire made of copper, etc., and a part constituted by a helically wound coil wire (no applicable symbol) having urethane, polyimide or other insulation sheath COA provided on the surface of the metal wire. In addition, the coil integrally has two leader parts 12*a* provided at the two ends of the wound part on sides 180 degrees apart from each other, as well as terminal parts 13 connected to the ends of the leader parts 12*a* and wider than the leader parts 12*a*. As for the metal wire constituting the coil wire, one having a circular cross section is desirable. However, a wire whose metal wire has a rectangular cross-section or any other cross-section shape can also be used as the coil wire.

As shown in FIGS. 2 (A) and 2 (B), the terminal part 13 consists of a band-shaped wide part 12*b* constituted by the metal wire at the end of the coil wire being crushed flat, and a soldered part SOL covering the wide part 12*b*. As evident from FIG. 2 (C), the wide part 12*b* of each terminal part 13 consists of two adjoining wide parts 12*b*. In other words, each terminal part 13 is formed in such a way that two overlapping wide parts 12*b* are entirely covered by the soldered part SOL.

As evident from FIGS. 1 (A) and 1 (B), the boundary between each leader part 12*a* and each terminal part 13 is positioned in the magnetic body 11. Also, the end of each terminal part 13 is exposed from the corresponding side of the magnetic body 11, and folded in a L shape along the side face and bottom face of the magnetic body. Furthermore, each terminal part 13 is positioned in such a way that the magnetic flux traveling through the wound part of the coil 12 will not pass through each terminal part 13 as much as possible, in order to minimize the eddy current loss.

FIGS. 3 to 12 show a process for manufacturing the aforementioned inductor 10.

First, a coil 12 integrated with terminal parts 13 is prepared before the manufacturing.

To be specific, a coil is shaped in such a way that it has a wound part constituted by the coil wire mentioned above wound helically to the specified axial diameter (inner diameter), winding width (height) and number of windings, as well as two leader parts 12*a* provided at the two ends of the wound part on sides 180 degrees apart from each other, as shown in FIG. 3.

Next, the insulation sheath COA at the end of each leader part 12*a* is partially removed from each end to expose the metal wire, as shown in FIG. 4.

Next, the metal wire exposed at the end of each leader part 12*a* is crushed flat via press forming to form each first crushed part 12*b*1, as shown in FIG. 5.

Next, the first crushed parts 12*b*1 are folded by 180 degrees at roughly the center in lengthwise direction and the two folded sections are overlapped with each other, respectively, to form overlapped parts 12*b*2, as shown in FIG. 6.

Next, solder that has been melted by heat is applied to cover the entire overlapped parts 12*b*2 and the solder is cured to form first soldered parts Sa1, as shown in FIG. 7.

Next, the overlapped parts 12*b*2 and first soldered parts Sa1 are crushed flat by press forming to form second crushed parts 12*b*3 and second soldered parts Sa2, as shown in FIG. 8. As a result of this crushing, the thickness of the second crushed parts 12*b*3 becomes smaller than the thickness of the first crushed parts 12*b*1.

Next, the second crushed parts 12*b*3 and second soldered parts Sa2 shown in FIG. 8 are cut and trimmed to the necessary shapes, or preferably along the lines outlining the folding areas of the second crushed parts 12*b*3 as shown by the alternate long and two short dashes lines in FIG. 8.

As a result, a coil 12 that integrally has terminal parts 13, each consisting of a band-shaped wide part 12*b* and a soldered part SOL covering the wide part 12*b*, is formed, as shown in FIG. 9. Although FIG. 9 shows a coil whose folding areas of the second crushed parts 12*b*3 have been removed by trimming, the folding areas may be kept on the wide parts 12*b* by changing the dimension settings, such as shortening the length of the metal wire to be exposed.

Then, the coil 12 shown in FIG. 9 is used, along with the dies shown in FIGS. 10 and 11, to pressure-form a magnetic body material and bury the coil 12. For your information, M11, M12, M13, and M14 shown in FIGS. 10 and 11 indicate a bottom punch, die, top outer punch and top inner punch, respectively.

To be specific, each terminal part 13 of the coil 12 is sandwiched between the die M12 and top outer punch and then the bottom punch M11 is lowered to a specified position, after which the aforementioned magnetic body material MP is filled into the space enclosed by the bottom punch M11, die M12 and top outer punch M13, as shown in FIG. 10.

Next, the bottom punch M11 is raised, while the top inner punch M14 is lowered, to pressure-form the magnetic body material MP to a specified rectangular solid shape in the space enclosed by the bottom punch M11, die M12, top outer punch M13 and top inner punch M14, as shown in FIG. 11.

As a result, the coil 12 is buried in the formed body MB in such a way that the boundary between each leader part 12*a* and each terminal part 13 of the coil 12 is positioned in the formed body MB and that the end of each terminal part 13 of the coil 12 is exposed from the corresponding side face of the formed body MB.

Next, the top outer punch M15 and top inner punch M14 are raised, after which the formed body MB in which the coil 12 is buried is taken out and the formed body MB is cured.

Next, the end of each terminal part 13 exposed from the side face of the magnetic body 11 is folded into an L shape along the side face and bottom face of the magnetic body 11 in a manner allowing for surface mounting, as shown in FIG. 12.

Next, burrs at the edges and other parts of the magnetic body 11 are removed. Now, the inductor 10 that can be surface-mounted, as shown in FIGS. 1 (A) and 1 (B), has been manufactured.

The aforementioned inductor 10 has a structure where the boundary between each leader part 12*a* and each terminal part 13 of the coil 12 is positioned in the magnetic body 11, while the end of each terminal part 13 is exposed to the surface of the magnetic body 11. Accordingly, stress does not generate easily at the boundary between each leader part 12 and each terminal part 13 wider than the leader part 12, even when an external force is applied to the exposed part of each terminal part 13 or when the inductor is soldered to a circuit board, and thus the risks of generation at the aforementioned boundary of cracks that cause poor connection due to wire breakage, etc., can be eliminated.

Also on the aforementioned inductor 10, each terminal part 13 of the coil 12 consists of band-shaped wide parts 12*b*, formed by crushing flat the metal wire exposed from each leader part 12*a*, and a soldered part SOL covering the wide part 12*b*. In addition, each terminal part 13 has appropriate hardness and viscosity suitable for bending, which enable easy folding of the exposed end of each terminal part 13 after curing and also prevents cracks from generating at the folded locations.

Furthermore with the aforementioned inductor 10, each wide part 12*b* of each terminal part 13 consists of two adjoining wide parts 12*b*, and therefore a width dimension favorable to surface mounting can be ensured for each terminal part 13 even when the diameter or cross-section area of the metal wire constituting the coil wire is small.

On the other hand, the aforementioned inductor 10 manufacturing method allows the aforementioned inductor 10 to be manufactured in a favorable and stable manner.

Also under the aforementioned inductor 10 manufacturing method, each terminal part 13 is formed by a method whereby: (a) the insulation sheath COA at the end of each leader part 12*a* is partially removed from each end to expose the metal wire; (b) the exposed metal wire at each leader part 12*a* is crushed flat by press forming to form a first crushed part 12*b*1; (c) the first crushed part 12*b*1 is folded by 180 degrees roughly at the center in lengthwise direction and the two folded sections are overlapped with each other to form an overlapped part 12*b*2; (d) solder that has been melted by heat is applied to cover the entire overlapped part 12*b*2 and then the solder is cured to form a first soldered part Sa1; (e) the overlapped part 12*b*2 and first soldered part Sa1 are crushed flat by press forming to form a second crushed part 12*b*3 and second soldered part Sa2; and (f) the second crushed part 12*b*3 and second soldered part Sa2 are trimmed to the necessary shape. Accordingly, each terminal part 13 having a width dimension favorable to surface mounting can be formed appropriately even when the diameter or cross-section area of the metal wire constituting the coil wire is small.

FIGS. 13 to 16 show the first variation example of the coil creation method explained by citing FIGS. 3 to 9.

To be specific, a coil is shaped in such a way that it has a wound part constituted by the coil wire mentioned above wound helically to the specified axial diameter (inner diameter), winding width (height) and number of windings, as well as two leader parts 12*a* provided at the two ends of the wound part on sides 180 degrees apart from each other, in a manner similar to the method illustrated in FIGS. 3 and 4. Next, the insulation sheath COA of each leader part 12*a* is partially removed from each end to expose the metal wire.

Next, the exposed metal wire at each leader part 12*a* is folded by 180 degrees roughly at the center in lengthwise direction to form each folded part 12*c*1, as shown in FIG. 13.

Next, solder that has been melted by heat is applied to cover the entire folded parts 12*c*1 and then the solder is cured to form first soldered parts Sb1, as shown in FIG. 14.

Next, the folded parts 12*c*1 and first soldered parts Sb1 are crushed flat by press forming to form crushed parts 12*c*2 and second soldered parts Sb2, as shown in FIG. 15.

Next, the crushed parts 12*c*2 and second soldered parts Sb2 in FIG. 15 are cut and trimmed to the necessary shapes, or preferably along the lines outlining the folding areas of the crushed parts 12*c*2 as shown by the alternate long and two short dashes lines in FIG. 15.

As a result, a coil 12 that integrally has terminal parts 13-1, each consisting of a band-shaped wide part 12*c* and a soldered part SOL covering the wide part 12*c*, is formed, as shown in FIG. 16. Although FIG. 16 shows a coil whose folding areas of the crushed parts 12*c*2 have been removed by trimming, the folding areas may be kept on the wide parts 12*c* by changing the dimension settings, such as shortening the length of the metal wire to be exposed.

FIGS. 17 to 20 show the second variation example of the coil creation method explained by citing FIGS. 3 to 9.

To be specific, a coil is shaped in such a way that it has a wound part constituted by the coil wire mentioned above wound helically to the specified axial diameter (inner diameter), winding width (height) and number of windings, as well as two leader parts 12*a* provided at the two ends of the wound part on sides 180 degrees apart from each other, in a manner similar to the method illustrated in FIGS. 3 and 4. Next, the insulation sheath COA of each leader part 12*a* is partially removed from each end to expose the metal wire.

Next, the exposed metal wire at the end of each leader part 12*a* is folded by 180 degrees roughly at the center in lengthwise direction to form each folded part 12*d*1, as shown in FIG. 17.

Next, the folded parts 12*d*1 are crushed flat by press forming to form crushed parts 12*d*2, as shown in FIG. 18.

Next, solder that has been melted by heat is applied to cover the entire crushed parts 12*d*2 and then the solder is cured to form first soldered parts Sc1, as shown in FIG. 19.

Next, the crushed parts 12*d*2 and first soldered parts Sc1 in FIG. 19 are cut and trimmed to the necessary shapes, or preferably along the lines outlining the folding areas of the crushed parts 12*d*2 as shown by the alternate long and two short dashes lines in FIG. 19.

As a result, a coil 12 that integrally has terminal parts 13-2, each consisting of a band-shaped wide part 12*d* and a soldered part SOL covering the wide part 12*d*, is formed, as shown in FIG. 20. Although FIG. 20 shows a coil whose folding areas of the crushed parts 12*b*2 have been removed by trimming, the folding areas may be kept on the wide parts 12*d* by changing the dimension settings, such as shortening the length of the metal wire to be exposed.

FIGS. 21 to 25 show the third variation example of the coil creation method explained by citing FIGS. 3 to 9.

To be specific, a coil is shaped in such a way that it has a wound part constituted by the coil wire mentioned above wound helically to the specified axial diameter (inner diameter), winding width (height) and number of windings, as well as two leader parts 12*a* provided at the two ends of the wound part on sides 180 degrees apart from each other, in a manner similar to the method illustrated in FIGS. 3 and 4. Next, the insulation sheath COA of each leader part 12*a* is partially removed from each end to expose the metal wire.

Next, the exposed metal wire at the end of each leader part 12*a* is crushed flat by press forming to form each first crushed part 12*e*1, as shown in FIG. 21.

Next, the first crushed parts 12*e*1 are folded by 180 degrees roughly at the center in lengthwise direction and the two folded sections are overlapped each other, respectively to form overlapped parts 12*e*2, as shown in FIG. 22.

Next, the overlapped parts 12*e*2 are crushed flat by press forming to form second crushed parts 12*e*3, as shown in FIG. 23. As a result of this crushing, the thickness of the second crushed parts 12*e*3 becomes smaller than the thickness of the first crushed parts 12*e*1.

Next, solder that has been melted by heat is applied to cover the entire second crushed parts 12*e*3 and then the solder is cured to form first soldered parts Sd1, as shown in FIG. 24.

Next, the second crushed parts 12*e*3 and first soldered parts Sd1 in FIG. 24 are cut and trimmed to the necessary shapes, or preferably along the lines outlining the folding areas of the second crushed parts 12*e*3 as shown by the alternate long and two short dashes lines in FIG. 24.

As a result, a coil 12 that integrally has terminal parts 13-3, each consisting of a band-shaped wide part 12*e* and a soldered part SOL covering the wide part 12*e*, is formed, as shown in FIG. 25. Although FIG. 25 shows a coil whose folding areas of the second crushed parts 12*e*3 have been removed by trimming, the folding areas may be kept on the wide parts 12*e* by changing the dimension settings, such as shortening the length of the metal wire to be exposed.

The foregoing explanations illustrated methods for forming a terminal part including: (1) a method to crush and fold the exposed metal wire, cover with solder, and then crush again (refer to FIGS. 3 to 9); (2) a method to fold the exposed metal wire, cover with solder, and crush (refer to FIGS. 13 to 16); (3) a method to fold and crush the exposed metal wire and then cover with solder (refer to FIGS. 17 to 20); and (4) a method to crush and fold the exposed metal wire, crush again, and then cove with solder (refer to FIGS. 21 to 25). If the diameter or cross-section area of the metal wire constituting the coil wire used is small, or to obtain wider terminal parts 13, the folding step in each of the aforementioned methods may be repeated twice or more. This way, terminal parts 13, each having two or more adjoining wide parts 12*b*, can be obtained.

EMBODIMENT 2

FIGS. 26 (A) to 26 (C) provide a top view, bottom view and side view, respectively, of an inductor which illustrates another embodiment of the present invention.

The inductor 20 shown in these figures has a magnetic body 21 of a rectangular solid shape and a coil 22 buried in the magnetic body 21.

The magnetic body 21 is formed by pressure-forming a magnetic body material to a rectangular solid shape and then curing the formed body. For your information, examples of magnetic body materials currently in use include, among others, known materials such as those that include at least permalloy, sendust or other magnetic metal powder, or epoxy, phenol, silicone or other binding agent.

The coil 22, whose top view, side view and enlarged cross-section view of the terminal (enlarged cross-section view of b-b) are shown in FIGS. 27 (A) to 27 (C), consists of a metal wire made of copper, etc., and a part constituted by a helically wound coil wire (no applicable symbol) having urethane, polyimide or other insulation sheath COA provided on the surface of the metal wire. In addition, the coil integrally has two leader parts 22*a* leading in the same direction and provided at the two ends of the wound part, as well as terminal parts 23 connected to the ends of the leader parts 22*a* and wider than the leader parts 22*a*. As for the metal wire constituting the coil wire, one having a circular cross section is desirable. However, a wire whose metal wire has a rectangular cross-section or any other cross-section shape can also be used as the coil wire.

As shown in FIGS. 27 (A) to 27 (C), the terminal part 23 consists of a band-shaped wide part 22*b* constituted by the exposed metal wire at the end of each leader part 22*a* wire being crushed flat, and a soldered part SOL covering the wide part 22*b*.

As evident from FIGS. 27 (A) and 27 (B), the boundary between each leader part 22*a* and each terminal part 23 is positioned in the magnetic body 21. Also, each terminal part 23 is bent/shaped in a reverse-C shape where a vertical part 23*a*, exposed part 23*b* and stopper part 23*c* are continued sequentially and the bottom face of each exposed part 23*b* is exposed at the bottom face of the magnetic body 21. Furthermore, each terminal part 23 is positioned in such a way that the magnetic flux traveling through the wound part of the coil 22 will not pass through each terminal part 23 as much as possible, in order to minimize the eddy current loss.

FIGS. 28 to 34 show a process for manufacturing the aforementioned inductor 20.

First, a coil 22 integrated with terminal parts 23 is prepared before the manufacturing.

To be specific, a coil is shaped in such a way that it has a wound part constituted by the coil wire mentioned wound helically to the specified axial diameter (inner diameter), winding width (height) and number of windings, as well as two leader parts 22*a* leading in the same direction and provided at the two ends of the wound part, as shown in FIG. 28.

Next, the insulation sheath COA at the end of each leader part 22*a* is partially removed from each end to expose the metal wire, as shown in FIG. 29.

Next, solder that has been melted by heat is applied to cover the entire metal wire exposed at the end of each leader part 22*a*, and then the solder is cured to form each first soldered part Se1, as shown in FIG. 30.

Next, the metal wire and first soldered parts Se1 are crushed flat by press forming to form crushed parts 22*b*1 and second soldered parts Se2, as shown in FIG. 31.

Next, the crushed parts 22*b*1 and second soldered parts Se2 shown in FIG. 31 are cut and trimmed to the necessary shapes, or preferably along the lines shown by the alternate long and two short dashes lines in FIG. 31.

As a result, a coil 22 that integrally has terminal parts 23, each consisting of a band-shaped wide part 22*b* and a soldered part SOL covering the wide part 22*b*, is formed, as shown in FIG. 32.

Next, Each terminal part 23 is bent/shaped in a reverse-C shape having a vertical part 23*a*, exposed part 23*b* and stopper part 23*c*, as shown in FIG. 27.

Then, the coil 22 shown in FIG. 27 is used, along with the dies shown in FIGS. 33 and 34, to pressure-form a magnetic body material and bury the coil 22. For your information, M21, M22 and M23 shown in FIGS. 33 and 34 indicate a bottom punch, die and top punch, respectively.

To be specific, an adhesive tape (not illustrated) is attached to the bottom face of the exposed part 23*b* of each terminal part 23 of the coil 22, and then each terminal part 23 of the coil 22 is placed on the bottom punch M21 via the adhesive tape, after which the bottom punch M21 is lowered to a specified position and the aforementioned magnetic body material MP is filled in the space enclosed by the inner faces of the bottom punch M21 and die M22, as shown in FIG. 33.

Next, the top punch M23 is lowered toward the top face of the bottom punch M21 to pressure-form the magnetic body material MP to a specified rectangular solid shape in the space enclosed by the bottom punch M21, die M22 and top punch M23, as shown in FIG. 34.

As a result, the coil 22 is buried in the formed body MB in such a way that the boundary between each leader part 22*a* and each terminal part 23 of the coil 22 is positioned in the formed body MB and that the exposed part 23*b*, to which the adhesive tape is attached, of each terminal part 23 of the coil 22 is exposed at the bottom face of the formed body MB in parallel.

Next, the top punch M23 is raised to take out the formed body MB in which the coil 22 is buried, and the formed body MB is cured.

Next, the adhesive tape exposed at the bottom face of the magnetic body 21 is removed from the bottom face of the exposed part 23*b* of each terminal part 23.

Next, burrs at the edges and other parts of the magnetic body 21 are removed. Now, the inductor 20 that can be surface-mounted, as shown in FIGS. 26 (A) to 26 (C), has been manufactured.

The aforementioned inductor 20 has a structure where the boundary between each leader part 22*a* and each terminal part 23 of the coil 22 is positioned in the magnetic body 21, while the exposed part 23*b* of each terminal part 23 is exposed to the surface of the magnetic body 21. Accordingly, stress does not generate easily at the boundary between each leader part 22 and each terminal part 23 wider than the leader part 22, even when an external force is applied to the exposed part of each terminal part 23 or when the inductor is soldered to a circuit board, and thus the risks of generation at the aforementioned boundary of cracks that cause poor connection due to wire breakage, etc., can be eliminated.

Also on the aforementioned inductor 20, each terminal part 23 of the coil 22 consists of a band-shaped wide part 22*b* formed by crushing flat the metal wire exposed at the end of each leader part 22*a*, and a soldered part SOL covering the wide part 22*b*, and also each terminal part 23 has appropriate hardness and viscosity suitable for bending, which enable easy folding of each terminal part 23 in a reverse-C shape before the forming of magnetic body material and also prevents cracks from generating at the folded locations.

Furthermore with the aforementioned inductor 20, the stopper part 23*c* provided at the tip (in front of the exposed part 23*b*) of each terminal part 23 is buried in the magnetic body 21, and therefore the separation and coming-off of the exposed part 23*b* of each terminal part 23 from the magnetic body 21 during or after soldering can be suppressed.

On the other hand, the aforementioned inductor 20 manufacturing method allows the aforementioned inductor 20 to be manufactured in a favorable and stable manner.

Also under the aforementioned inductor 20 manufacturing method, an adhesive tape is attached to the bottom face of the exposed part 23*b* of each terminal part 23 of the coil 22 before the magnetic body material is pressure-formed, and then the adhesive tape is removed from the bottom face of the exposed part 23*b* of each terminal part 23 after curing. This prevents the magnetic body material from attaching to and thereby soiling the bottom face of the exposed part 23*b* of each terminal 23 during the forming of magnetic body material.

FIGS. 35 to 37 show the first variation example of the coil creation method explained by citing FIGS. 28 to 32 and 27.

To be specific, a coil is shaped in such a way that it has a wound part constituted by the coil wire mentioned above wound helically to the specified axial diameter (inner diameter), winding width (height) and number of windings, as well as two leader parts 22*a* leading in the same direction and provided at the two ends of the wound part, in a manner similar to the method illustrated in FIGS. 28 and 29. Next, the insulation sheath COA of each leader part 22*a* is partially removed from each end to expose the metal wire.

Next, the exposed metal wire at the end of each leader part 22*a* is crushed flat by press forming to form each crushed part 22*c*1, as shown in FIG. 35.

Next, solder that has been melted by heat is applied to cover the entire crushed parts 22*c*1 and then the solder is cured to form first soldered parts Sf1, as shown in FIG. 36.

Next, the crushed parts 22*c*1 and first soldered parts Sf1 in FIG. 36 are cut and trimmed to the necessary shapes, or preferably along the lines shown by the alternate long and two short dashes lines in FIG. 36.

As a result, a coil 22 that integrally has terminal parts 23-1, each consisting of a band-shaped wide part 22*c* and a soldered part SOL covering the wide part 22*c*, is formed, as shown in FIG. 37.

Next, each terminal part 23-1 is bent/shaped in a reverse-C shape to form each vertical part 23*a*, exposed part 23*b* and stopper part 23*c*, as shown in FIG. 27.

The foregoing explanations illustrated methods for forming a terminal part including: (1) a method to cover the exposed metal wire with solder and then crush, and (2) a method to crush the exposed wire and then cover with solder. If the diameter or cross-section area of the metal wire constituting the coil wire used is small, however, any of the methods for forming a terminal part explained under Embodiment 1 can be adopted as deemed appropriate, where said methods specifically include: (1) a method to crush and fold the exposed metal wire, cover with solder, and then crush again (refer to FIGS. 3 to 9); (2) a method to fold the exposed metal wire, cover with solder and crush (refer to FIGS. 13 to 16); (3) a method to fold and crush the exposed metal wire and then cover with solder (refer to FIGS. 17 to 20); and (4) a method to crush and fold the exposed metal wire, crush again, and then cove with solder (refer to FIGS. 21 to 25).

Of course, if the diameter or cross-section area of the metal wire constituting the coil wire used is small, or to obtain wider terminal parts 23, the folding step in each of the aforementioned methods may be repeated twice or more.

Also, the foregoing explanations illustrated examples where a stopper 23*c* was provided at the tip of each terminal part 23 roughly in perpendicular to the exposed part 23*b*. However, a greater coming-off prevention effect can be achieved by: providing the stopper part 23*c*1 at a sharp angle with the exposed part 23*b*, as shown in FIG. 38 (A); providing the stopper part 23*c*2 at a dull angle with the exposed part 23*b*, as shown in FIG. 38 (B); providing a through hole SH in the stopper part 23*c*3, as shown in FIG. 39 (A); or providing a cutout CR in the stopper part 23*c*4, as shown in FIG. 39 (B).

Needless to say, the shape of the stopper part 23*c* is not limited to rectangle, and the stopper part 23*c*5 may have an isosceles triangle, as shown in FIG. 40 (A), or the stopper part 23*c*6 may have a right-angled triangle shape, as shown in FIG. 40 (B), or any other shape may be used.

Also, the metal wire exposed at the end of each leader part 12*a* or 22*a* may be left uncrushed and the uncrushed end may be bent, in order to form a column-shaped stopper part 23*c*7, as shown in FIG. 40 (C), if the metal wire constituting the coil wire has a circular cross-section shape. If the metal wire constituting the coil wire has a rectangular cross-section shape, a square-column-shaped stopper part 23*c*8 may be formed, as shown in FIG. 40 (D).

The present application claims priority to Japanese Patent Application No. 2007-296394, filed Nov. 15, 2007, the disclosure of which is incorporated herein by reference in its entirety.

It will be understood by those of skill in the art that numerous and various modifications can be made without departing from the spirit of the present invention. Therefore, it should be clearly understood that the forms of the present invention are illustrative only and are not intended to limit the scope of the present invention.

What is claimed is:

1. An inductor with a magnetic body and a coil embedded in the magnetic body, wherein the coil integrally has a part constituted by a helically wound coil wire, two leader parts provided at two respective ends of the wound coil wire, and terminal parts connected to respective ends of the leader parts and having a width wider than that of the respective leader parts, where a boundary between each leader part and each terminal part is positioned inside the magnetic body and each terminal part is partially exposed from a surface of the magnetic body, wherein the coil wire comprises a metal wire and an insulation sheath provided on a surface of the metal wire, and each terminal part comprises a wide part constituted by a part of the metal wire at the end of the coil wire being crushed flat and a soldered part covering the wide part, and wherein the wide part of each terminal part is comprised of two or more adjoining wide parts.

2. The inductor according to claim 1, wherein the coil is embedded in the magnetic body, except for an end of each terminal part which is exposed from the surface of the magnetic body, and the exposed end of each terminal part is folded along the surface of the magnetic body.

3. The inductor according to claim 1, wherein each terminal part of the coil is bent/shaped and partially exposed from the surface of the magnetic body.

4. The inductor according to claim 1, wherein the magnetic body has a rectangular solid shape.

5. The inductor according to claim 2, wherein the exposed end of each terminal part is folded in an L shape along the surface of the magnetic body.

6. A method for manufacturing the inductor with a magnetic body and a coil embedded in the magnetic body as defined in claim 1, comprising:

as a coil forming process, helically winding a coil wire to integrally form a wound part, two leader parts at respective ends of the wound part, and terminal parts connected to the respective leader parts and being wider than the leader parts, wherein the coil wire has a metal wire and an insulation sheath provided on a surface of the metal wire, and the coil forming process comprises a step of partially removing the insulation sheath at each end of the coil wire to expose a part of the metal wire and crushing the exposed part of metal wire flat, and a step of applying molten solder to cover the metal wire before or after the crushing step and then cure the solder, wherein the coil forming process further comprises a step of folding the exposed part of the metal wire once or multiple times to form the two or more adjoining wide parts of each terminal part;

as a magnetic-body material forming process, pressure-forming a magnetic body material by embedding the coil wire in the pressure-formed body so that a boundary between each leader part and each terminal part of the coil wire is positioned in the pressure-formed body and each terminal part of the coil wire is partially exposed from the pressure-formed body; and as a magnetic-body forming process, curing the pressure-formed body in which the coil wire is embedded to form a magnetic body.

7. The inductor manufacturing method according to claim 6, wherein in the magnetic-body material forming process, the coil wire is embedded in the pressure-formed body except for an end of each terminal part which is exposed from the terminal part, and the method further comprises after the magnetic-body forming process a step of folding the exposed end of each terminal part along the surface of the magnetic body.

8. The inductor according to claim 1, wherein the two or more adjoining wide parts overlap each other as viewed in an axial direction of the helically wound coil wire, and entirely covered by the solder part.

9. The inductor according to claim 8, wherein the two leader parts extend from the part constituted by the helically wound coil wire in opposite directions.

* * * * *